US010488053B2

(12) United States Patent
Briscoe et al.

(10) Patent No.: US 10,488,053 B2
(45) Date of Patent: Nov. 26, 2019

(54) APPARATUS AND METHOD FOR COOLING GAS COOKTOP KNOBS

(71) Applicants: BSH Home Appliances Corporation, Irvine, CA (US); BSH Hausgeräte GmbH, Munich (DE)

(72) Inventors: Ray Briscoe, Havelock, NC (US); Conor Cross, New Bern, NC (US); Michael Gerdes, Trent Woods, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 143 days.

(21) Appl. No.: 15/163,831

(22) Filed: May 25, 2016

(65) Prior Publication Data

US 2017/0343219 A1 Nov. 30, 2017

(51) Int. Cl.

| | |
|---|---|
| ***F24C 15/00*** | (2006.01) |
| ***F24C 3/12*** | (2006.01) |
| ***F24C 15/10*** | (2006.01) |

(52) U.S. Cl.
CPC ..... *F24C 15/006* (2013.01); *F24C 3/126* (2013.01); *F24C 15/101* (2013.01)

(58) Field of Classification Search
CPC ..... F24C 15/006; F24C 15/101
See application file for complete search history.

(56) References Cited

U.S. PATENT DOCUMENTS 3,494,350 A * 2/1970 Perl ..... F23C 99/00 126/15 R
4,551,600 A * 11/1985 Miyagawa ..... H05B 6/1263 126/299 D
6,349,714 B1 * 2/2002 Hurley ..... F24C 3/085 126/21 R
7,049,552 B2 * 5/2006 Arntz ..... F24C 15/101 126/15 R (Continued)

FOREIGN PATENT DOCUMENTS

CN 201819266 U 5/2011

OTHER PUBLICATIONS

Zanussi, "Zanussi Ultra Flat 5-burner gas hob", Jul. 22, 2013, http://appliancist.com/cooking/cooktops/zanussi-ultra-flat-5-burner-gas-hob.html.*

(Continued)

*Primary Examiner* — Steven S Anderson, II
(74) *Attorney, Agent, or Firm* — Michael E. Tschupp; Andre Pallapies; Brandon G. Braun

(57) ABSTRACT

A cooktop has a top sheet; a space below the top sheet; a first passageway through the top sheet; a second passageway through the top sheet; a first gas burner that draws primary combustion air from the space below the top sheet; a first gas control knob that controls an amount of gas that flows to the first gas burner, the first gas control knob protruding through the first passageway; a second gas burner that draws primary combustion air from the space below the top sheet; and a second gas control knob that controls an amount of gas that flows to the second gas burner, the second gas control knob protruding through the second passageway. The first passageway and the second passageway have different airflow rates at a given negative air pressure in the space below the top sheet.

33 Claims, 5 Drawing Sheets

(56) References Cited

U.S. PATENT DOCUMENTS

| | | | | |
|---|---|---|---|---|
| 7,279,659 | B2 * | 10/2007 | Gagas | F24C 7/08 219/385 |
| 8,269,148 | B2 * | 9/2012 | Marchand | F24C 15/101 219/449.1 |
| 8,757,138 | B2 | 6/2014 | Shaffer et al. | |
| 2002/0045142 | A1 * | 4/2002 | Repper | F23N 1/005 431/66 |
| 2012/0048256 | A1 * | 3/2012 | Shaffer | F24C 15/101 126/42 |

OTHER PUBLICATIONS

Industrial Combustion, "Q-Series", Apr. 24, 2014 (last modified date of the webpage), http://www.ind-comb.com/Documents/Brochures/IC-SA-1731%20Q%20Brochure%204-2014.pdf.*

Wolf, "Muli Function Cooktop", Dec. 2013, http://www.subzero-wolf.com/-/media/files/united-states/product-downloads/sub-zero-wolf/use-and-care/wolf/multifunction-cooktop-ucg.pdf.*

* cited by examiner

APPARATUS AND METHOD FOR COOLING GAS COOKTOP KNOBS

FIELD OF THE INVENTION

The invention is directed to an apparatus and method related to optimizing the cooling of knobs on a gas cooktop.

An example of an application for the invention is a domestic kitchen gas cooktop having improved cooling of the knobs used to control gas flow.

BACKGROUND OF THE INVENTION

Some modern domestic kitchens include a gas cooktop as either a countertop mounted cooktop or as a part of a standalone range.

Some domestic cooktops have one or more control knobs that control the amount of gas that is piped to specific gas burners of the cooktop. Some cooktops have a top sheet that is formed from, for example, a piece of sheet steel. The burners protrude through the top sheet such that the heating flames of the burners exist above the top sheet. In some of these cooktops, primary combustion air is drawn from a space below the top sheet and mixed with gas before being ignited. In some cases, the primary combustion air enters the space below the top sheet through holes in the top sheet that exist around shafts of the control knobs.

In some domestic cooktops, the proximity of a control knob to a burner can result in the temperature of the control knob rising above an ideal level.

Applicants recognized this problem and developed a solution as described herein. Applicants also recognized that a control knob that is relatively close to an active burner can be heated by the air drawn through the hole in the top sheet because that air is heated by the burner.

SUMMARY

The invention achieves the benefit of routing primary combustion air past one or more gas control knobs to cool the control knobs. The invention achieves this benefit by providing different size control knob passageways through the top sheet. The passageways can be the holes in the top sheet through which the control knob shafts extend. In some embodiments only one passageway has a size that is different from the other passageways. In other embodiments two or more passageways have a different size.

For the comfort of the appliance user, a knob cooling strategy can be very beneficial. In addition, there are government regulatory limits on control knob temperatures under specified operating conditions.

Embodiments of the invention are based on the inventors' recognition that regulating the amount of air allowed to flow around each of the control knobs and through the top sheet can positively influence cooling of a particular control knob. This regulation of the air flow can include regulation of air flow around a gas control knob that is closest to a particular burner and/or regulation of air flow around a gas control knob that controls a particular burner. In particular embodiments, air flow around any gas control knob in the off position would be prevented altogether or limited to a greater extent than air flow around any gas control knob in an on position or vice versa where there is an advantage to utilize cool air that may be around the knob to cool the knob when the burner is on.

Several methods can be employed to provide the above described air flow control. There are active solutions and passive solutions. Examples of active solutions include a cam activated bezel around the knob or the knob shaft that opens in an on position of the control knob and closes in the off position of the control knob. Other examples of active solutions take advantage of the often-present feature of the control knob being in different vertical positions depending on whether the control knob is in an on position or the off position. In these examples, a damper, for example a disk, can be attached to the valve shaft of the control knob such that it moves vertically with the control knob and opens or closes an opening as a result of that movement. Other embodiments use a solenoid valve triggered by the rotation of the gas control knob or a signal from the ignition switch to control the air flow in the on or off position.

Passive solutions include providing holes of different sizes around the different control knob shafts. If one control knob tends to be hotter than others, providing a different size hole around the shaft of the hotter control knob can provide more cooling air flow and therefore a cooler control knob.

In determining the optimal air flow for a particular cooktop and/or situation, the turndown ratio (which is the ratio between the highest heat and the lowest heat) must be considered. If total air flow is reduced too far, a low burning flame can be extinguished (or at least negatively affected) by a lack of sufficient air flow.

Particular embodiments of the invention are directed to a domestic home gas cooktop having a top sheet; a space below the top sheet; a first passageway through the top sheet; a second passageway through the top sheet; a first gas burner that draws primary combustion air from the space below the top sheet; a first gas control knob that controls an amount of gas that flows to the first gas burner, the first gas control knob protruding through the first passageway; a second gas burner that draws primary combustion air from the space below the top sheet; and a second gas control knob that controls an amount of gas that flows to the second gas burner, the second gas control knob protruding through the second passageway. The first passageway and the second passageway have different airflow rates at a given negative air pressure in the space below the top sheet.

Other embodiments of the invention are directed to a method of cooling a gas control knob on a domestic home gas cooktop having a top sheet, a space below the top sheet, a first passageway through the top sheet, a second passageway through the top sheet, a first gas burner that draws primary combustion air from the space below the top sheet, a first gas control knob that controls an amount of gas that flows to the first gas burner, the first gas control knob protruding through the first passageway, a second gas burner that draws primary combustion air from the space below the top sheet, a second gas control knob that controls an amount of gas that flows to the second gas burner, the second gas control knob protruding through the second passageway. The method includes configuring the first passageway differently from the second passageway such that the first passageway and the second passageway have different airflow rates at a given negative air pressure in the space below the top sheet; and causing the first gas control knob and the second gas control knob to be subjected to different cooling as a result of the different airflow rates.

Particular embodiments include the feature of the first passageway being a first hole in the top sheet, and the second passageway being a second hole in the top sheet.

Particular embodiments include the feature of the first hole having a first hole cross-sectional area, the second hole having a second hole cross-sectional area, and the first hole cross-sectional area and the second hole cross-sectional area being different.

Particular embodiments include the feature of the second hole being located farther from the first gas burner than the first hole is located from the first gas burner, and the second hole cross-sectional area being larger than the first hole cross-sectional area.

Particular embodiments include the feature of each of the passageways having a closest burner distance that is defined as a distance between that passageway and the closest one of the burners to that passageway, the closest burner distance of a particular passageway being larger than the closest burner distance of all others of the passageways, and a cross-sectional area of the particular passageway being larger than a cross-sectional area of each other passageway.

Particular embodiments include the feature of a first grommet located in the first hole, the first grommet having an opening having a first grommet cross-sectional area; and a second grommet located in the second hole, the second grommet having an opening having a second grommet cross-sectional area, wherein the first grommet cross-sectional area and the second grommet cross-sectional area are different.

Particular embodiments include the feature of the first hole having a first hole cross-sectional area, the second hole having a second hole cross-sectional area, and the first hole cross-sectional area being equal to the second hole cross-sectional area.

Particular embodiments include the feature of the first gas control knob having a skirt that projects downward from the first gas control knob, the skirt being in a first position that blocks substantially all air from passing through the first hole when the first gas control knob is in a gas off position, and the skirt being in a second position that allows air to pass through the first hole when the first gas control knob is in a gas on position.

Particular embodiments include the feature of the first gas control knob has a shaft and a disk attached to the shaft, the disk being in a first position that blocks substantially all air from passing through the first hole when the first gas control knob is in a gas off position, and the disk being in a second position that allows air to pass through the first hole when the first gas control knob is in a gas on position.

Particular embodiments include the feature of the disk being located below the top sheet and is positionaly fixed relative to a user contact portion of the first gas control knob.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide a solution to the problems associated with elevated temperatures of gas control knobs on a cooktop.

Figure 1:
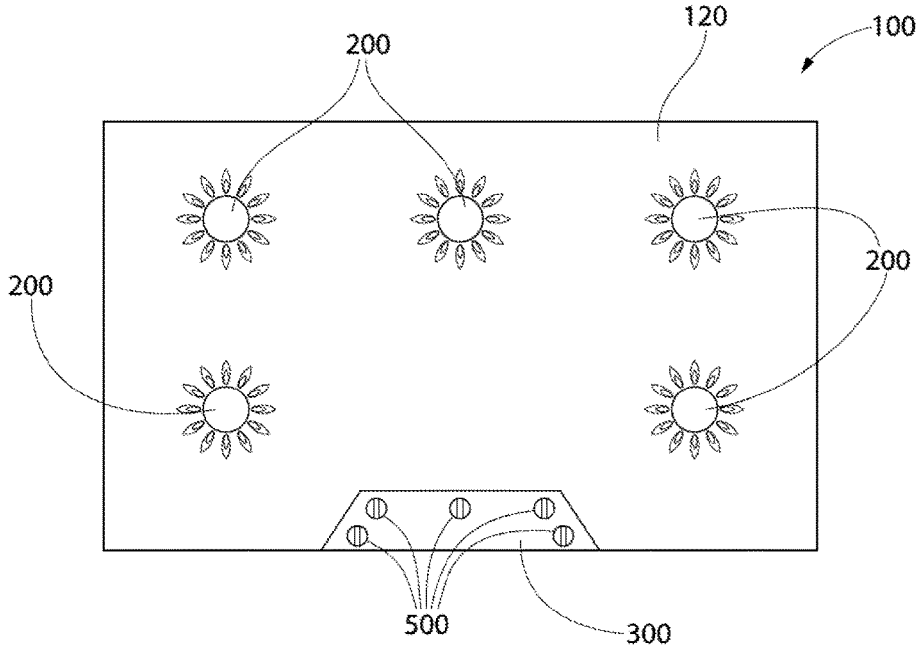
FIG. 1 is a top view of an exemplary cooktop in accordance with embodiments of the invention.
Figure 2:
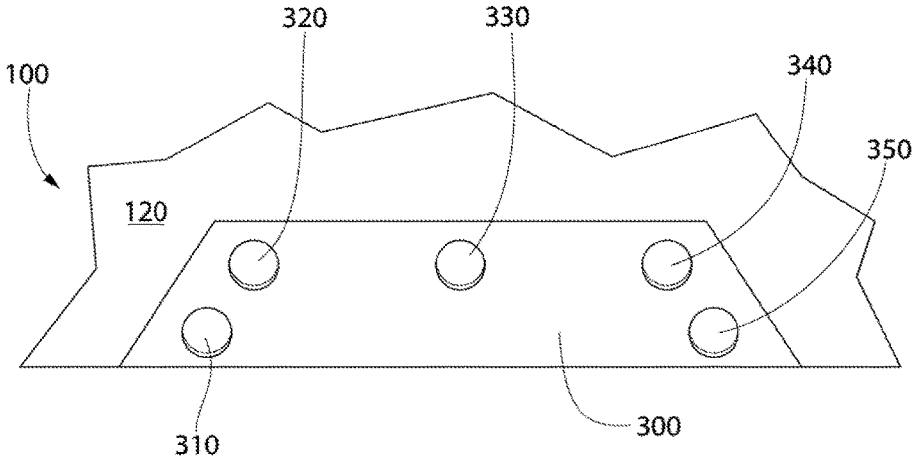
FIG. 2 is a partial top view of an exemplary embodiment of the invention.
Figure 3:
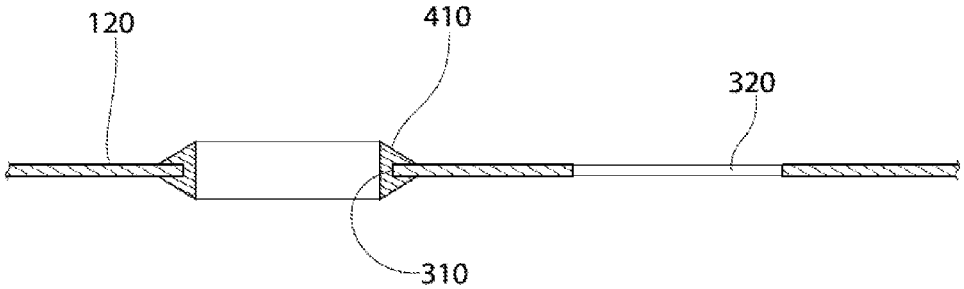
FIG. 3 is a partial sectional view of an exemplary embodiment of the invention.

FIG. 1 shows an example of a cooktop 100 that has a top sheet 120 through which five burners 200 protrude. A control panel 300 has a gas control knob 500 for each burner 200. In some embodiments, one gas control knob 500 is mounted to a shaft that protrudes through top sheet 120 and is connected to a gas flow control valve that is located below top sheet 120. As shown in FIG. 2, control panel 300 has five holes 310, 320, 330, 340, 350 through which a shaft for each control knob 500 extends. In this example, each hole 310, 320, 330, 340, 350 is the same size. As shown in FIG. 3, a grommet 410 can be placed in each of hole 310, 320, 330, 340, 350 for esthetic reasons and/or to help prevent pieces of food, etc., from falling through the holes and thus through the top sheet.

As explained above, the gas control knobs can become heated by their proximity to a burner that is burning gas.

As discussed above, primary combustion air can be provided to the burner from the space below the top sheet. There is often a box-like structure below the top sheet that contains the lower part of the burners, a gas manifold, gas control valves, control wiring, and other parts of the cook top. This box-like structure can be completely or substantially sealed so that little or no combustion air is drawn from the space below the cook top. As a result, all or substantially all of the primary combustion air comes from the area above the top sheet. One of the ways primary combustion air can enter the space below the top sheet is by way of the holes through which the gas control knob shafts extend. This air flow can be used to cool the gas control knobs.

Figure 4:
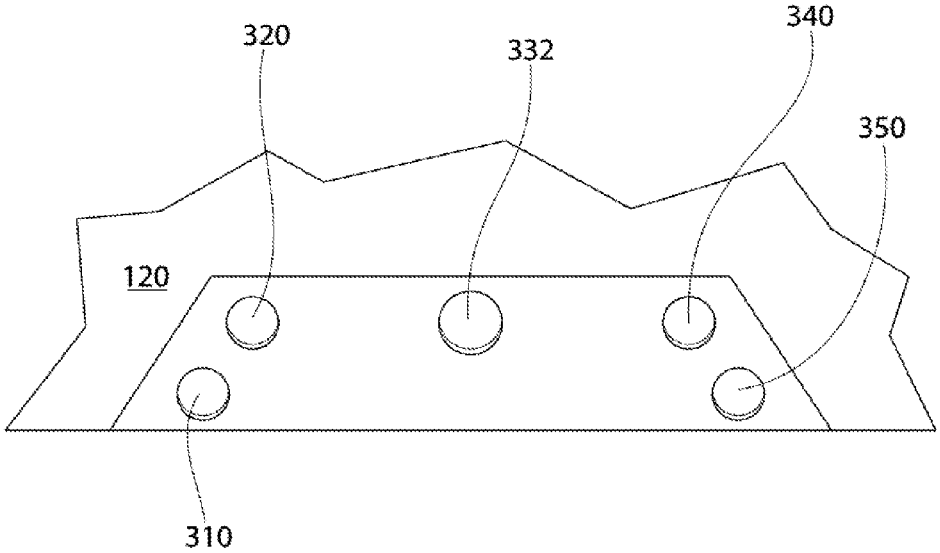
FIG. 4 is a partial top view of an exemplary embodiment of the invention.

One way to provide cooling of a particular gas control knob is to alter the amount of primary combustion air that is drawn through that control knob's hole in the top sheet. One example of how an embodiment of the invention provides more air flow for a particular control knob is shown in FIG. 4. In FIG. 4, hole 332 is larger than holes 310, 320, 340, 350 and therefore can provide more airflow.

In some situations, enlarging the hole that is nearest to a particular burner, for example the front right burner in FIG. 1, can increase air flow around the control knob associated with that hole and thus cool that control knob.

In some situations, more air flow through a particular hole can actually heat the control knob associated with that hole. For example, if the front right burner in FIG. 1 is lit it is possible that the control knobs associated with holes 340 and 350 can become heated. If hole 340 and/or hole 350 is made larger, air heated by the front right burner can be drawn into the larger hole and actually increase the temperature of the control knobs associated with those holes.

As a result of these two situations, burner maximum intensity and proximity of the control knobs to the burners must be considered when determining the propper relative size of the holes in the top sheet.

Figure 5:
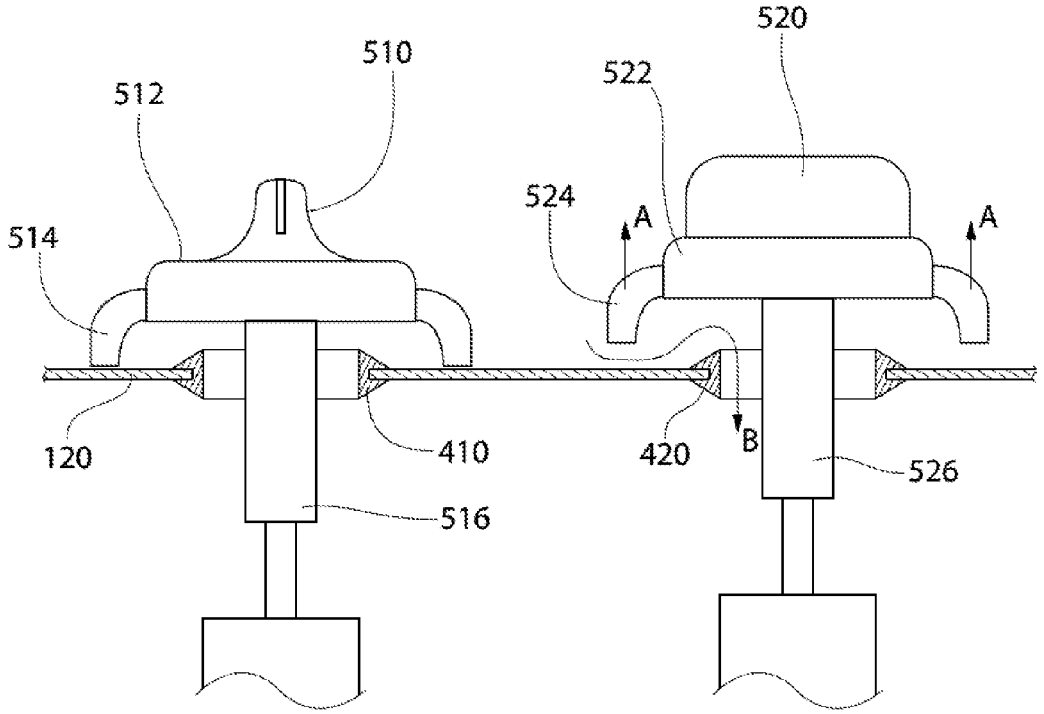
FIG. 5 is a partial sectional view of an exemplary embodiment of the invention.

FIG. 5 shows an example of an active method of controlling air flow through the top sheet. In FIG. 5 control knob 510 has a user-contact portion 512 and a skirt 514. Control knob 510 has a shaft 516 that extends through a hole in top sheet 120. A grommet 410 lines the hole. Similarly, control knob 520 has a user-contact portion 522 and a skirt 524. Control knob 520 has a shaft 526 that extends through a hole in top sheet 120. A grommet 420 lines the hole. Control knobs 510 and 520 are identical except that they are associated with different holes in the top sheet. Control knob 510 is in the off position, which is the position in which no gas flows to the burner associated with control knob 510. In contrast, control knob 520 is in an on position, which is one of the positions in which gas flows to the burner associated with control knob 520. As can be seen in FIG. 5, when control knob 520 is an open position it is raised vertically (Arrow A) as compared to the off position (as shown by control knob 510). In this or any other open position, the vertically raised position of control knob 520 allows cooling air to flow along the path of Arrow B and into the space below the top sheet. The burner that is in an on position creates a negative pressure by drawing primary combustion air from the space below the top sheet. This negative pressure draws cooling air around control knob 520.

Figure 6:
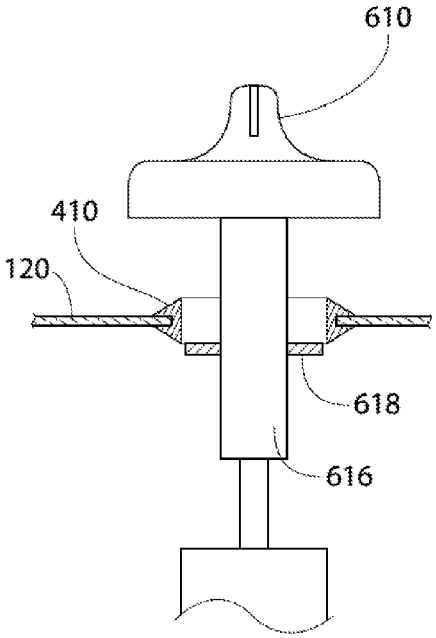
FIG. 6 is a partial sectional view of an exemplary embodiment of the invention in a closed position.
Figure 7:
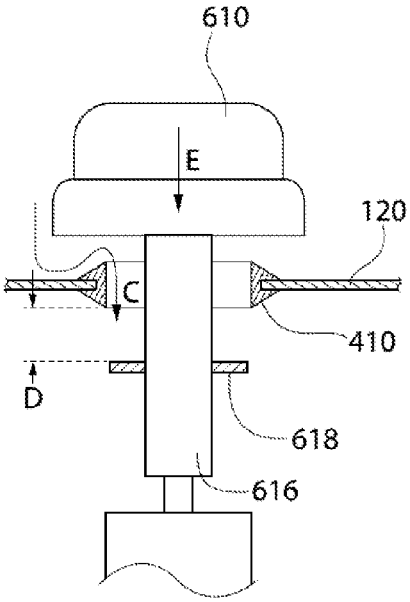
FIG. 7 is a partial sectional view of the embodiment shown in FIG. 6 in an open position.

FIGS. 6 and 7 show another example of an active method of controlling air flow through the top sheet. In FIGS. 6 and 7 control knob 610 has a shaft 616 that extends through a hole in top sheet 120. A disk 618 is fixed to shaft 616 such that it moves vertically with control knob 610. A grommet 410 lines the hole. In FIG. 6 control knob 610 is in the off position, which is the position in which no gas flows to the burner associated with control knob 610. In FIG. 7 control knob 610 is in an on position, which is one of the positions in which gas flows to the burner associated with control knob 610. As can be seen in FIG. 7, when control knob 610 is an open position it is lower vertically (Arrow E) as compared to the off position (as shown in FIG. 6). In this or any other open position, the vertically lower position of control knob 610 moves disk 618 downward and away from grommet 410, this allowing cooling air to flow along the path of Arrow C and into the space below the top sheet. As stated above, the burner that is in an on position creates a negative pressure by drawing primary combustion air from the space below the top sheet. This negative pressure draws cooling air around control knob 610.

Figure 8:
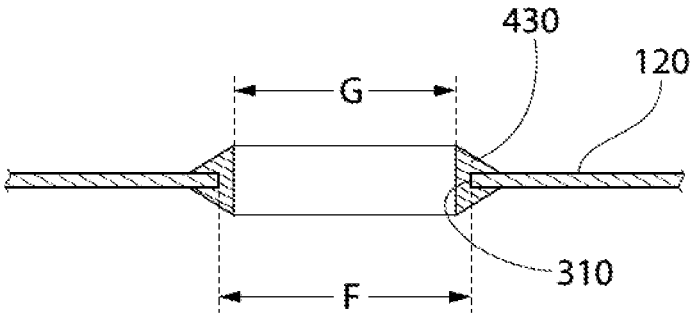
FIG. 8 is a partial sectional view of an exemplary embodiment of the invention.
Figure 9:
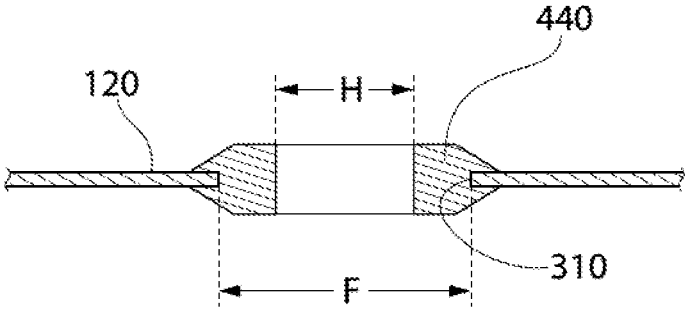
FIG. 9 is a partial sectional view of an exemplary embodiment of the invention.

An example of a passive method of controlling cooling air flow is shown in FIGS. 8 and 9. As discussed above with reference to FIG. 4, holes of different sizes can be used to control the relative air flow through different holes in the top sheet. Enabling the tailoring of hole size to different models of cooktops without having to change the size of the holes formed in the top sheet can reduce production and stocking costs and difficulty. By providing the top sheet with holes of a uniform size and then providing a variety of grommet sizes, different hole sizes can be achieved while simultaneously avoiding having to manufacture multiple different top sheets. For example, FIGS. 8 and 9 both show hole 310 having a diameter F. However, FIG. 8 shows hole 310 having a grommet 430 that has an internal hole of diameter G while FIG. 9 shows hole 310 having a grommet 440 that has an internal hole of diameter H that is smaller than G. By using grommet 440 instead of grommet 430, the example in FIG. 9 provides a smaller air flow hole. By inserting the proper size grommets in each of the holes in a particular application, optimum control knob cooling can be achieved.

As can be seen in the above exemplary embodiments, the invention provides solutions to the problems associated with the undesirable heating of gas control knobs on a gas cooktop.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic home gas cooktop, comprising:

a top sheet;

a space below the top sheet;

a first passageway through the top sheet;

a second passageway through the top sheet;

a first gas burner that draws primary combustion air from the space below the top sheet;

a first gas control knob that controls an amount of gas that flows to the first gas burner, the first gas control knob protruding through the first passageway;

a second gas burner that draws primary combustion air from the space below the top sheet; and a second gas control knob that controls an amount of gas that flows to the second gas burner, the second gas control knob protruding through the second passageway, wherein the first passageway and the second passageway have different airflow rates at a given negative air pressure in the space below the top sheet such that the first gas control knob and the second gas control knob are subjected to different cooling as a result of the different airflow rates, wherein the first passageway is a first hole in the top sheet, and the second passageway is a second hole in the top sheet, and wherein the first gas control knob has a skirt that projects downward from the first gas control knob, the skirt is in a first position in which a portion of the skirt contacts the top sheet around a perimeter of the first hole such that the skirt blocks substantially all air from passing through the first hole when the first gas control knob is in a gas off position, and the skirt is in a second position in which the portion of the skirt is separated from the top sheet such that the skirt allows air to pass through the first hole when the first gas control knob is in a gas on position.

2. The domestic home gas cooktop of claim 1, wherein the first hole has a first hole cross-sectional area, the second hole has a second hole cross-sectional area, and the first hole cross-sectional area and the second hole cross-sectional area are different.

3. The domestic home gas cooktop of claim 2, wherein the second hole is located farther from the first gas burner than the first hole is located from the first gas burner, and the second hole cross-sectional area is larger than the first hole cross-sectional area.

4. The domestic home gas cooktop of claim 2, further comprising a third passageway through the top sheet;

a third gas burner that draws primary combustion air from the space below the top sheet;

a third gas control knob that controls an amount of gas that flows to the third gas burner, the third gas control knob protruding through the third passageway;

a fourth passageway through the top sheet;

a fourth gas burner that draws primary combustion air from the space below the top sheet;

a fourth gas control knob that controls an amount of gas that flows to the fourth gas burner, the fourth gas control knob protruding through the fourth passageway;

a fifth passageway through the top sheet;

a fifth gas burner that draws primary combustion air from the space below the top sheet; and a fifth gas control knob that controls an amount of gas that flows to the fifth gas burner, the fifth gas control knob protruding through the fifth passageway, wherein each of the passageways has a closest burner distance that is defined as a distance between that passageway and the closest one of the burners to that passageway, the closest burner distance of the third passageway is larger than the closest burner distance of all others of the passageways, and a cross-sectional area of the third passageway is larger than a cross-sectional area of each one of the other passageways.

5. The domestic home gas cooktop of claim 1 further comprising a first grommet located in the first hole, the first grommet having an opening having a first grommet cross-sectional area; and a second grommet located in the second hole, the second grommet having an opening having a second grommet cross-sectional area, wherein the first grommet cross-sectional area and the second grommet cross-sectional area are different.

6. The domestic home gas cooktop of claim 5, wherein the first hole has a first hole cross-sectional area, the second hole has a second hole cross-sectional area, and the first hole cross-sectional area is equal to the second hole cross-sectional area.

7. The domestic home gas cooktop of claim 1, wherein the first passageway has a first cross-sectional area and the second passageway has a second cross-sectional area, and wherein the second cross-sectional area is larger than the first cross-sectional area such that the first gas control knob and the second gas control knob are subjected to different cooling as a result of the different airflow rates through the first passageway and the second passageway at the given negative air pressure in the space below the top sheet.

8. The domestic home gas cooktop of claim 1, wherein the first passageway has a first cross-sectional area and the second passageway has a second cross-sectional area, and the first cross-sectional area is equal to the second cross-sectional area, and further comprising a first grommet located in the first passageway, the first grommet having an opening having a first grommet cross-sectional area, wherein the first grommet cross-sectional area of the first grommet is smaller than the second cross-sectional area of the second passageway such that the first gas control knob and the second gas control knob are subjected to different cooling as a result of the different airflow rates through the first grommet cross-sectional area and the second passageway at the given negative air pressure in the space below the top sheet.

9. The domestic home gas cooktop of claim 8, further comprising:

a second grommet located in the second passageway, the second grommet having an opening having a second grommet cross-sectional area, wherein the first grommet cross-sectional area and the second grommet cross-sectional area are different such that the first gas control knob and the second gas control knob are subjected to the different cooling as a result of the different airflow rates through the first grommet cross-sectional area and the second grommet cross-sectional area at the given negative air pressure in the space below the top sheet.

10. A domestic home gas cooktop, comprising:

a top sheet;

a space below the top sheet;

a first passageway through the top sheet;

a second passageway through the top sheet;

a first gas burner that draws primary combustion air from the space below the top sheet;

a first gas control knob that controls an amount of gas that flows to the first gas burner, the first gas control knob protruding through the first passageway;

a second gas burner that draws primary combustion air from the space below the top sheet; and a second gas control knob that controls an amount of gas that flows to the second gas burner, the second gas control knob protruding through the second passageway, wherein the first passageway and the second passageway have different airflow rates at a given negative air pressure in the space below the top sheet such that the first gas control knob and the second gas control knob are subjected to different cooling as a result of the different airflow rates, wherein the first passageway is a first hole in the top sheet, and the second passageway is a second hole in the top sheet, and wherein the first gas control knob has a shaft and a disk attached to the shaft, the disk is in a first position in which a portion of the disk contacts the top sheet around a perimeter of the first hole such that the disk blocks substantially all air from passing through the first hole when the first gas control knob is in a gas off position, and the disk is in a second position in which the portion of the disk is separated from the top sheet such that the disk allows air to pass through the first hole when the first gas control knob is in a gas on position.

11. The domestic home gas cooktop of claim 10, wherein the disk is located below the top sheet and is positionaly fixed relative to a user contact portion of the first gas control knob.

12. The domestic home gas cooktop of claim 10, wherein the first hole has a first hole cross-sectional area, the second hole has a second hole cross-sectional area, and the first hole cross-sectional area and the second hole cross-sectional area are different.

13. The domestic home gas cooktop of claim 12, wherein the second hole is located farther from the first gas burner than the first hole is located from the first gas burner, and the second hole cross-sectional area is larger than the first hole cross-sectional area.

14. The domestic home gas cooktop of claim 12, further comprising a third passageway through the top sheet;

a third gas burner that draws primary combustion air from the space below the top sheet;

a third gas control knob that controls an amount of gas that flows to the third gas burner, the third gas control knob protruding through the third passageway;

a fourth passageway through the top sheet;

a fourth gas burner that draws primary combustion air from the space below the top sheet;

a fourth gas control knob that controls an amount of gas that flows to the fourth gas burner, the fourth gas control knob protruding through the fourth passageway;

a fifth passageway through the top sheet;

a fifth gas burner that draws primary combustion air from the space below the top sheet; and a fifth gas control knob that controls an amount of gas that flows to the fifth gas burner, the fifth gas control knob protruding through the fifth passageway, wherein each of the passageways has a closest burner distance that is defined as a distance between that passageway and the closest one of the burners to that passageway, the closest burner distance of the third passageway is larger than the closest burner distance of all others of the passageways, and a cross-sectional area of the third passageway is larger than a cross-sectional area of each one of the other passageways.

15. The domestic home gas cooktop of claim 10, further comprising:

a first grommet located in the first hole, the first grommet having an opening having a first grommet cross-sectional area; and a second grommet located in the second hole, the second grommet having an opening having a second grommet cross-sectional area, wherein the first grommet cross-sectional area and the second grommet cross-sectional area are different.

16. The domestic home gas cooktop of claim 15, wherein the first hole has a first hole cross-sectional area, the second hole has a second hole cross-sectional area, and the first hole cross-sectional area is equal to the second hole cross-sectional area.

17. The domestic home gas cooktop of claim 10, wherein the first passageway has a first cross-sectional area and the second passageway has a second cross-sectional area, and wherein the second cross-sectional area is larger than the first cross-sectional area such that the first gas control knob and the second gas control knob are subjected to different cooling as a result of the different airflow rates through the first passageway and the second passageway at the given negative air pressure in the space below the top sheet.

18. The domestic home gas cooktop of claim 10, wherein the first passageway has a first cross-sectional area and the second passageway has a second cross-sectional area, and the first cross-sectional area is equal to the second cross-sectional area, and further comprising a first grommet located in the first passageway, the first grommet having an opening having a first grommet cross-sectional area, wherein the first grommet cross-sectional area of the first grommet is smaller than the second cross-sectional area of the second passageway such that the first gas control knob and the second gas control knob are subjected to different cooling as a result of the different airflow rates through the first grommet cross-sectional area and the second passageway at the given negative air pressure in the space below the top sheet.

19. The domestic home gas cooktop of claim 18, further comprising:

a second grommet located in the second passageway, the second grommet having an opening having a second grommet cross-sectional area, wherein the first grommet cross-sectional area and the second grommet cross-sectional area are different such that the first gas control knob and the second gas control knob are subjected to the different cooling as a result of the different airflow rates through the first grommet cross-sectional area and the second grommet cross-sectional area at the given negative air pressure in the space below the top sheet.

20. A domestic home gas cooktop, comprising:

a top sheet;

a space below the top sheet;

a first passageway through the top sheet;

a second passageway through the top sheet;

a first gas burner that draws primary combustion air from the space below the top sheet;

a first gas control knob that controls an amount of gas that flows to the first gas burner, the first gas control knob protruding through the first passageway;

a second gas burner that draws primary combustion air from the space below the top sheet; and a second gas control knob that controls an amount of gas that flows to the second gas burner, the second gas control knob protruding through the second passageway, wherein the first passageway and the second passageway have different airflow rates at a given negative air pressure in the space below the top sheet, and wherein the first gas control knob has a skirt that projects downward from the first gas control knob, the skirt is in a first position that closes the first passageway when the first gas control knob is in a gas off position, and the skirt is in a second position that opens the first passageway when the first gas control knob is in a gas on position.

21. The domestic home gas cooktop of claim 20, wherein the first passageway has a first cross-sectional area and the second passageway has a second cross-sectional area, and wherein the second cross-sectional area is larger than the first cross-sectional area such that the first gas control knob and the second gas control knob are subjected to different cooling as a result of the different airflow rates through the first passageway and the second passageway at the given negative air pressure in the space below the top sheet.

22. The domestic home gas cooktop of claim 21, wherein the first passageway is a first hole in the top sheet, and the second passageway is a second hole in the top sheet.

23. The domestic home gas cooktop of claim 21, wherein the second hole is located farther from the first gas burner than the first hole is located from the first gas burner, and the second hole cross-sectional area is larger than the first hole cross-sectional area.

24. The domestic home gas cooktop of claim 20, wherein the first passageway has a first cross-sectional area and the second passageway has a second cross-sectional area, and the first cross-sectional area is equal to the second cross-sectional area, and further comprising:

a first grommet located in the first passageway, the first grommet having an opening having a first grommet cross-sectional area, wherein the first grommet cross-sectional area of the first grommet is smaller than the second cross-sectional area of the second passageway such that the first gas control knob and the second gas control knob are subjected to different cooling as a result of the different airflow rates through the first grommet cross-sectional area and the second passageway at the given negative air pressure in the space below the top sheet.

25. The domestic home gas cooktop of claim 24, further comprising:

a second grommet located in the second passageway, the second grommet having an opening having a second grommet cross-sectional area, wherein the first grommet cross-sectional area and the second grommet cross-sectional area are different such that the first gas control knob and the second gas control knob are subjected to the different cooling as a result of the different airflow rates through the first grommet cross-sectional area and the second grommet cross-sectional area at the given negative air pressure in the space below the top sheet.

26. A domestic home gas cooktop, comprising:

a top sheet;

a space below the top sheet;

a first passageway through the top sheet;

a second passageway through the top sheet;

a first gas burner that draws primary combustion air from the space below the top sheet;

a first gas control knob that controls an amount of gas that flows to the first gas burner, the first gas control knob protruding through the first passageway;

a second gas burner that draws primary combustion air from the space below the top sheet; and a second gas control knob that controls an amount of gas that flows to the second gas burner, the second gas control knob protruding through the second passageway, wherein the first passageway and the second passageway have different airflow rates at a given negative air pressure in the space below the top sheet, and wherein the first gas control knob has a shaft and a disk attached to the shaft, the disk is in a first position that closes the first passageway when the first gas control knob is in a gas off position, and the disk is in a second position that opens the first passageway when the first gas control knob is in a gas on position.

27. The domestic home gas cooktop of claim 26, wherein the first passageway has a first cross-sectional area and the second passageway has a second cross-sectional area, and wherein the second cross-sectional area is larger than the first cross-sectional area such that the first gas control knob and the second gas control knob are subjected to different cooling as a result of the different airflow rates through the first passageway and the second passageway at the given negative air pressure in the space below the top sheet.

28. The domestic home gas cooktop of claim 27, wherein the second hole is located farther from the first gas burner than the first hole is located from the first gas burner, and the second hole cross-sectional area is larger than the first hole cross-sectional area.

29. The domestic home gas cooktop of claim 26, wherein the first passageway is a first hole in the top sheet, and the disk closes the first passageway in the first position by closing the first hole in the top sheet.

30. The domestic home gas cooktop of claim 26, further comprising:

a first grommet located in the first passageway, the first grommet having an opening, wherein the disk closes the first passageway in the first position by closing the opening in the first grommet.

31. The domestic home gas cooktop of claim 26, wherein the first passageway has a first cross-sectional area and the second passageway has a second cross-sectional area, and the first cross-sectional area is equal to the second cross-sectional area, and further comprising:

a first grommet located in the first passageway, the first grommet having an opening having a first grommet cross-sectional area, wherein the first grommet cross-sectional area of the first grommet is smaller than the second cross-sectional area of the second passageway such that the first gas control knob and the second gas control knob are subjected to different cooling as a result of the different airflow rates through the first grommet cross-sectional area and the second passageway at the given negative air pressure in the space below the top sheet.

32. The domestic home gas cooktop of claim 31, further comprising:

a second grommet located in the second passageway, the second grommet having an opening having a second grommet cross-sectional area, wherein the first grommet cross-sectional area and the second grommet cross-sectional area are different such that the first gas control knob and the second gas control knob are subjected to the different cooling as a result of the different airflow rates through the first grommet cross-sectional area and the second grommet cross-sectional area at the given negative air pressure in the space below the top sheet.

33. The domestic home gas cooktop of claim 26, wherein the disk is located below the top sheet and is positionaly fixed relative to a user contact portion of the first gas control knob.

* * * * *